United States Patent [19]

Lesas et al.

[11] 4,204,055

[45] May 20, 1980

[54] CROSS-LINKED CELLULOSE FIBERS

[75] Inventors: Claude H. Lesas, Colmar; Michel Pierre, Mulhouse, both of France

[73] Assignee: S. A. Beghin-Say, Thumeries, France

[21] Appl. No.: 940,189

[22] Filed: Sep. 7, 1978

Related U.S. Application Data

[63] Continuation-in-part of Ser. No. 731,895, Oct. 13, 1976, Pat. No. 4,113,936.

[30] Foreign Application Priority Data

Oct. 20, 1975 [FR] France ..... 75 31965

[51] Int. Cl.[2] ..... D06M 13/14

[52] U.S. Cl. ..... 536/56; 8/116.4; 8/120; 162/157 C

[58] Field of Search ..... 536/56; 8/116.4, 120; 162/157 C

[56] References Cited

U.S. PATENT DOCUMENTS

| | | | |
|---|---|---|---|
| 1,816,973 | 8/1931 | Kantorowicz | 8/116.4 |
| 2,010,635 | 8/1935 | Kantorowicz | 162/72 |
| 2,311,080 | 2/1943 | Pinkney | 8/116.4 |
| 3,046,079 | 7/1962 | Reeves et al. | 8/116.4 |
| 3,224,926 | 12/1965 | Bernardin | 8/116.4 |
| 3,230,108 | 1/1966 | Marek | 8/116.4 |
| 3,264,054 | 8/1966 | Reinhardt et al. | 8/116.4 |
| 3,287,083 | 11/1966 | Hushebeck | 8/116.4 |
| 3,310,363 | 3/1967 | Russell et al. | 8/116.4 |
| 3,440,135 | 4/1969 | Chung | 8/116.3 |
| 3,700,549 | 10/1972 | Croon et al. | 8/120 |
| 4,035,147 | 7/1977 | Sangenis et al. | 8/116.4 |

OTHER PUBLICATIONS

Chemical Abstracts, vol. 82, No. 14, Apr. 7, 1975, p. 87968M.

*Primary Examiner*—Ronald W. Griffin
*Attorney, Agent, or Firm*—A. W. Breiner

[57] ABSTRACT

The invention is directed to cross-linked cellulose fibers wherein cellulose pulp is fluffed, aerated, and exposed to a reaction mixture comprising formaldehyde, hydrochloric acid and formic acid as finely divided droplets or vapors. The thus treated fibers are cured by subjecting the fibers to a hot air stream at a temperature of from about 180°-200° C. for a duration of a few seconds, followed by separation of the fibers from the gaseous effluents. The procedure which lasts less than about one minute provides cellulose fibers cross-linked with formaldehyde wherein the predominant amount of cross-linking occurs at the surface of the fibers rather than at the core of the fibers. The fibers have improved characteristics including flexibility, touch and feel, rendering the fibers highly useful in paper products.

10 Claims, 1 Drawing Figure

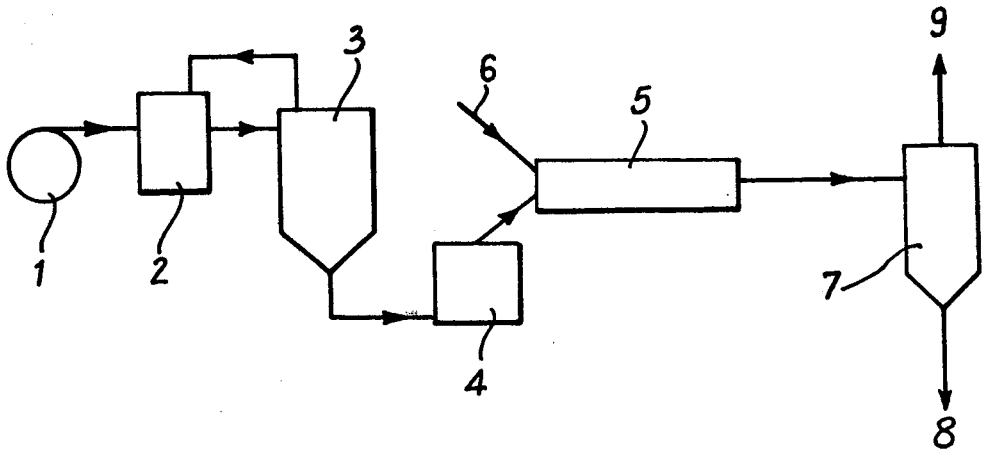
1
2
3
4
5
6
7
8
9

CROSS-LINKED CELLULOSE FIBERS

This application is a continuation-in-part of application Ser. No. 731,895 filed Oct. 13, 1976, now U.S. Pat. No. 4,113,936 issued on Sept. 12, 1978.

FIELD OF INVENTION AND BACKGROUND

This invention relates to cross-linked cellulose fibers and, more particularly, to cellulose pulp fibers which have been cross-linked with formaldehyde.

It is known that new characteristics, especially a greatly increased water absorptivity, can be imparted to cellulose fibers and particularly to wood fibers or cotton linters by subjecting the fibers to a cross-linking reaction. The cross-linking of the cellulose fibers is a double etherification of the primary alcohol groups of the anhydrogluclose units with the cross-linking agent. Cross-linking agents which have been suggested for use include formaldehyde, polyoxymethylene, trioxane, aminoplasts, and glyoxal in the presence of a low molecular weight organic acid, i.e., Lewis acids, as the catalyst. Other cross-linking components such as epichlorohydrin or other epoxides are reacted with cellulose in the presence of a basic catalytst. It is accepted in the art that the links between the anhydroglucose units of the cellulose chains hinder the formation of inter-fiber hydrogen or hydrate bonds, imparting stiffness to the fibers and increasing the water absorption through capillarity.

Cross-linked cellulose fibers have been employed in the preparation of napkins, sanitary pads, and diapers; and also in the preparation of sheet materials having improved bulk, softness, as well as reduced tensile strength. If employed with a resin binder, the modified fibers are particularly useful in the manufacture of nonwovens characterized by their improved softness, bulk, caliper, and absorbency.

Cross-linked cellulose fibers are disclosed in, for example, French Pat. No. 892,799 and U.S. Pat. No. 2,010,635. However, difficulties associated with the uniform cross-linking of cellulose fibers without destruction of other properties has led to many attempted improvements in the processes employed in providing cross-linked fibers as seen from U.S. Pat. No. 3,224,926; U.S. Pat. No. 3,440,135, and U.S. Pat. No. 3,700,549. U.S. Pat. Nos. 3,224,926 and 3,440,135 describe processes which require an impregnation step with the cross-linking agent or with the catalyst and a drying or storage step for periods of time up to forty-eight hours, followed by a defiberizing step and a thermal treatment step. The aforesaid references suggest that formaldehyde, which is the least expensive cross-linking agent known and fully effective at low levels, is less desirable than other cross-linking agents because of its volatility. The use of more expensive cross-linking agents and/or the long-aging or drying times have prevented wide-scale commercial manufacture of the cross-linked fibers. Moreover, due to the non-uniformity of the heretofore known processes and also the adverse effect on the cross-linked fibers as a result of long thermal treatments and long contact with the reagents including acids, the products obtained have not been fully acceptable.

It is also known in the prior art that paper or cardboard can be treated with formaldehyde. Note U.S. Pat. Nos. 1,816,973; 3,264,054, and 3,310,363. The processes disclosed in the noted patents are attempts to improve the physical properties, especially wet tensile strength of the sheets, and are not directed to the treatment of individual cellulose fibers.

It is also recognized in the prior art that in the cross-linking of the cellulose fibers as set forth in French Pat. No. 2,224,485 there is an inter-relationship between the concentration of the fibers and reagents, and specifically the percentage of water employed. It has been suggested that the amount of water can be reduced by utilizing a solvent such as acetone. However, the use of large amounts of acetone and the need for the generation of the solvent catalyst mixture adversely influenced such methods from commercial use.

SUMMARY OF INVENTION

It has now been found that an important feature of the cross-linking reaction is control of the thermal treatment and the length of time that the fibers are exposed to the cross-linking reagent since not only are the cellulose fibers adversely affected by heat and acids, but the control of temperature and time of exposure provide, inter alia, superior flexibility, feel and touch properties.

According to the present invention cross-linked fibers are prepared by spraying the reagents on individualized fibers which are subsequently subjected to a heat treatment in a system using hot air. The reaction time is extremely short (1–10 seconds). The temperature of the fibers does not reach more than 50° C. in the hot air stream which is at a temperature of from about 180°–200° C. Accordingly, the fibers are not damaged. More precisely, paper pulp is first fluffed, aerated, and then exposed to the reagents (vapor-phase or finely divided droplets) which contain 1% to 6% (by weight of the pulp) of formaldehyde and as a catalyst hydrochloric acid and formic acid. The fibers are subjected to hot air (180° C.) for a few seconds and finally separated from the gaseous effluents.

The fibers obtained by the aforesaid process are distinct from the fibers obtained from the heretofore known processes in that since the cellulosic fibers are not subjected to prolonged impregnation by the cross-linking reagents and do not undergo an aging step, the major amount of cross-linking occurs on the surface area of the fibers rather than at the core of the fibers. The fibers, therefore, are more flexible than the heretofore cross-linked cellulose fibers and as a result provide better feel and touch characteristics.

Accordingly, a primary object of the present invention is to provide cellulose fibers cross-linked with formaldehyde, with the cross-linking occurring to a substantial extent at the surface of the fibers to provide fibers which are flexible and have improved touch and feel characteristics, rendering them highly useful in the preparation of paper products where flexibility, touch and feel are essential characteristics.

BRIEF DESCRIPTION OF THE DRAWING

The drawing is a schematic flow-sheet of the preferred method for producing the cross-linked cellulose fibers of this invention. Fibers from pulp distributor means 1 are fed to fluffer 2. Fibers coming out from the fluffer 2 are dryed and aerated in the cyclone 3, then conducted into spraying unit 4 and into the tubular reaction vessel 5 together with a hot air stream 6. Cross-linked fibers are separated in the cyclone 7 and recuperated at 8. Air and effluents to be recycled come out at 9.

DESCRIPTION OF PREFERRED EMBODIMENTS

The paper pulp supply 1 is fluffed by a dry-process in the fluffer 2. The pulp might advantageously contain surface active compounds. Individual fibers (length: 1–3 mm; thickness: 8–10μ) without knots must be obtained. If the fibers are collapsed or matted together or not sufficiently aerated, they are conducted into a high velocity air stream in order to artificially increase their volume. The reagents are uniformly deposited on the aerated fibers by condensation of the reagents or by spraying until the dry content of the fibers reaches 70–80%. If a spray is used, the size of the droplets is critical as far as the efficiency and the rate of the reaction are concerned.

The preferred proportions of the reagents are as follows:

| Compounds | % By Weight Of The Fibers |
|---|---|
| Formaldehyde | 1–6 |
| Hydrochloric acid | up to 2 |
| Formic or acetic acid | 0–12 |
| Water | 2–19 |

In a preferred embodiment of the invention the reagents comprise formic or acetic acid in a proportion less than 50% of the sum of all reagent compounds. Cross-linking without formic acid is possible but if omitted more hydrochloric acid and more formaldehyde must be used. Charring of the fibers can then occur. Furthermore, in the absence of formic acid, formaldehyde is more volatile and the reaction is more difficult to control. The amount of hydrochloric acid is one of the most important parameters. An excess leads to a yellowing of the fibers. According to a preferred embodiment of the invention, 0.1%–0.2% (by weight of the pulp) of hydrochloric acid (or an HCl salt) is the optimal amount.

As noted above, formic acid can be omitted, but if it is omitted the cross-linked fibers are then less water absorbent. Formic acid apparently is a weak catalyst or an anchorage agent of the formaldehyde on the fibers and a swelling agent for the fibers.

Water can be used in order to dilute the mixture of reagents. The wetted fibers are cured in the tubular air-dryer 5 wherein the temperature can vary between 60° C. and 250° C., and the speed of the air stream can vary between 1 and 20 m/s. The cross-linked fibers are separated from the gaseous effluents in the cyclone 7. It may be necessary to dry the fibers again in order to remove all the contaminants.

EXAMPLES I TO V

Every curing step is conducted as a flash-drying at 180° C. for a duration of 2.5 seconds.

| Composition Of The Mixture % - The Amount Sprayed Is About 20 to 25% By Weight Of The Fibers | | | Color Of The Cross-Linked Fibers | Water Absorbents g/g | Comments |
|---|---|---|---|---|---|
| I. | HCHO | 20 | dark brown | 29 | — |
| | HCl | 12 | | | |
| | Water | 68 | | | |
| II. | HCHO | 19.5 | white | 15 | Reagents still present on the fibers |
| | HCOOH | 28 | | | |
| | Water | 52.5 | | | |
| III. | HCHO | 19 | white | 33 | — |
| | HCOOH | 27.7 | | | |
| | HCl | 0.8 | | | |
| | Water | 52.5 | | | |
| IV. | HCHO | 19 | light yellow | 30–31 | — |
| | HCl | 0.8 | | | |
| | Water | 80.2 | | | |
| V. | HCHO | 18 | yellow | 31 | With less catalyst white fibers might be obtained |
| | HCOOH | 27.5 | | | |
| | $NH_4Cl$ | 4.4 | | | |
| | $H_2O$ | 50.1 | | | |

The water absorption is measured as follows:

A handsheet (5 g pulp) is made on lab equipment and dryed two minutes under 3.5 Kg/cm$^2$. The handsheet is post-dryed two hours in an air-forced oven at 105° C. The degree of cross-linking can be found by a bulk determination. The handsheet is placed in a cylindrical basket with a conical bottom. The closed basket is dipped in a vessel containing 1 liter water and held in the water for three minutes. The basket is removed and drained one minute. The amount of water remaining in the vessel is measured. An untreated pulp sheet absorbs between 3 and 5 g/g.

The formaldehyde cross-linked cellulose fibers according to this invention have the predominant, i.e., greater than 50%, cross-linking at the surface area of the fibers in contrast to at the core of the fiber due to the short exposure time of the fibers to the cross-linking reagent and limited processing time. Accordingly, the fibers are flexible and have improved touch and feel.

It is claimed:

1. Cellulose fibers cross-linked with formaldehyde by the process comprising the steps of (1) spraying of formaldehyde as a mixture with hydrochloric acid and formic acid on individualized cellulose fibers;

(2) immediately after said spraying, introducing said fibers which have the reagents of step (1) uniformly disposed thereon into an air stream having a temperature of from about 60° and about 250° C., and a velocity of from about 1–20 m/sec during a curing-time period ranging between about 1 and 20 seconds to effect a cross-linking reaction; and (3) separating said fibers from said air stream.

2. The fibers obtained by the process according to claim 1 further characterized in that the air stream has a temperature between about 170° and 180° C.

3. The fibers obtained by the process according to claim 1 further characterized in that said individualized fibers are obtained through the step of fluffing crude and compacted pulp.

4. The fibers obtained by the process according to claim 3 further characterized in that the steps from fluffing to separating of said fibers from said air stream are carried out within less than one minute time.

5. The fibers obtained by the process according to claim 3 further characterized in that the fluffed pulp is heated.

6. The fibers obtained by the process according to claim 1 further characterized in that the amount of formic acid used in the mixture is less than 50% by weight with respect to the reagents.

7. The fibers obtained by the process according to claim 6 further characterized in that the amount of formic acid used is less than 12% by weight with respect to the fibers.

8. The fibers obtained by the process according to claim 1 further characterized in that the amount of hydrochloric acid used is from trace amounts and 2% by weight with respect to the fibers.

9. The fibers obtained by the process according to claim 1 further characterized in that the fibers are retained in the air stream for about 2 to 3 seconds.

10. Cellulose fibers cross-linked with formaldehyde, at least 50% of the cross-linking bridges being at the surface area of the fibers, thereby imparting flexibility and softness to the fibers.

* * * * *